United States Patent [19]

Kuhn

[11] 4,357,060

[45] Nov. 2, 1982

[54] BUSINESS MACHINE FRAME TO HOUSING CONNECTION

[75] Inventor: Lothar Kuhn, Frankfurt, Fed. Rep. of Germany

[73] Assignee: Adlerwerke vorm. Heinrich Kleyer, Nuremburg, Fed. Rep. of Germany

[21] Appl. No.: 219,577

[22] Filed: Dec. 23, 1980

[30] Foreign Application Priority Data

Apr. 15, 1980 [DE] Fed. Rep. of Germany ..... 3014284

[51] Int. Cl.[3] ..... A47B 95/00; F16M 1/00

[52] U.S. Cl. ..... 312/351; 312/208

[58] Field of Search ..... 312/351, 208, 140; 206/306; 248/680, 222.3, 222.4

[56] References Cited

U.S. PATENT DOCUMENTS

| | | | |
|---|---|---|---|
| 670,763 | 3/1901 | Brodeur | 248/680 |
| 3,147,943 | 9/1964 | Oldenburg et al. | 312/351 |
| 3,176,944 | 4/1965 | Crates | 248/222.4 |
| 3,206,265 | 9/1965 | Amos | 312/208 |

*Primary Examiner*—Victor N. Sakran

*Attorney, Agent, or Firm*—Joseph R. Spalla

[57] ABSTRACT

Side frames supporting mechanisms of a machine are provided with lugs for plug-in insertion into slots in a base housing for the machine which form the sole connection to the side frames. The base housing slots and the lugs on the side frames are so located as to provide side to side and front to back rigidity. Resilient material between the lugs and slots serve to frictionally clamp and secure the connections. The base housing includes detent structure to removably secure a cover housing to the base housing.

3 Claims, 4 Drawing Figures

Fig_2
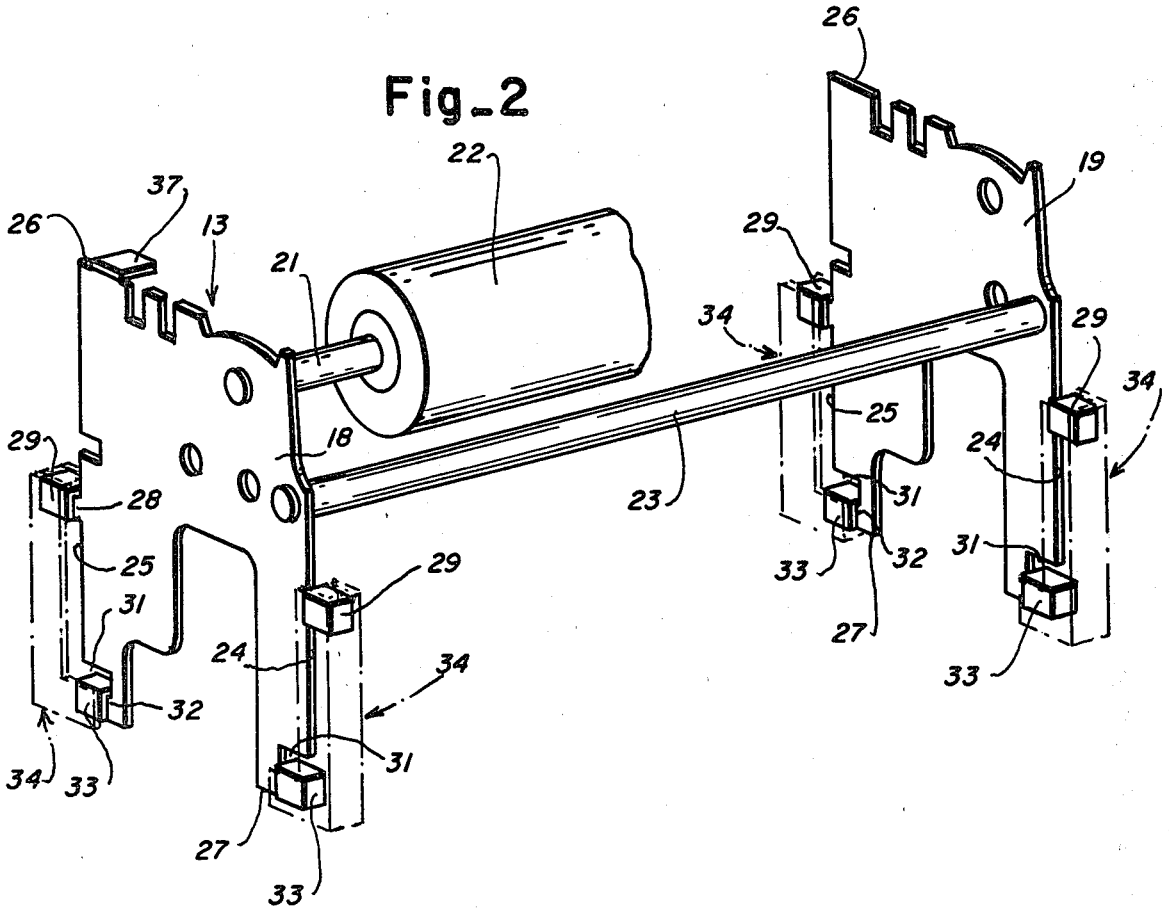
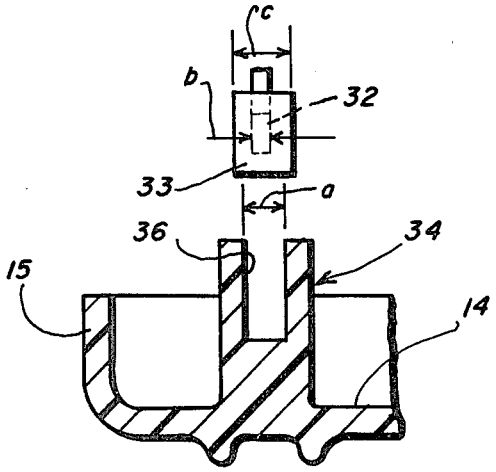
Fig_3
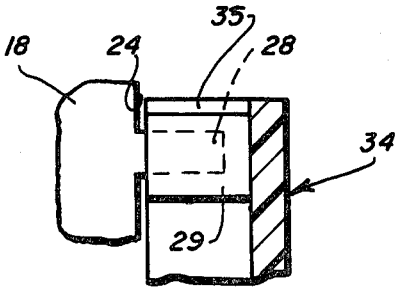
Fig_4

BUSINESS MACHINE FRAME TO HOUSING CONNECTION

This invention relates to connecting means for removably mounting a machine frame to the base of a machine housing; more particularly it relates to connecting means wherein projections or lugs on the machine frame bearing resilient sleeves are plugged into slots or grooves provided on the base of the machine housing; and specifically, it relates to a connecting means in which the projections and grooves are so located as to provide a stable side to side and front to back mounting with the resilient sleeves serving as frictional clamps and sound absorbers.

Business machine housings having base and cover portions made of molded plastic and supporting machine frames are known to the art. As shown in published German patent application Sch 2760 X11/15q, the connection of the machine frame to the base portion of the housing is by screws extending through supporting bosses into the machine frame. As shown is U.S. Pat. No. 3,147,943 the machine frame is connected to the base portion and to the cover portion as well; the connection to the base portion being by pins on the machine frame pushed into grommets supported in cups on the base portion, and the connection to the cover portion by similar male female connections. Neither of these facilitate mounting and removal of the machine frame from the housing in a cost effective manner. One requires the use of tools; the other requires connections to the cover to provide rigidity.

In accordance with the invention a machine frame is mounted solely to the base portion of a machine housing with connection points so located as to provide side to side and front to back rigidity yet allow easy insertion and removal of the machine frame in vertical direction. More particularly in accordance with the invention, lugs formed at the lower ends of machine side frames, and lugs extending from the side edges between the lower and upper edges of the machine side frames are fitted with resilient sleeves. The fitted lugs on the lower ends and the side projecting lugs of the machine frame are adapted to be pushed into and clampingly received in L-shaped slots formed in the base portion of a housing thereby to provide front to back and side to side support without the necessity for connection to a housing cover portion detentably attachable to the base portion.

An object of the invention is in the provision of means for facilitating the mounting of a machine frame to a housing.

Another object of the invention is in the provision of connecting means between a machine frame and its housing which facilitates manufacture and assembly with good sound absorption characteristics.

Another object of the invention is to provide a plug in mounting of the side frames of a machine to the base portion of a machine housing.

A further object of the invention is in the provision of plug in connections which resiliently support a machine frame in a machine housing against side to side and front to back movement.

Other objects, features and advantages of the present invention will become known to those skilled in the art from a reading of the following detailed description when taken in conjuction with the accompanying drawing wherein like reference numerals designate like or corresponding parts throughout the several views thereof, and wherein:

FIG. 2 is a perspective view of a machine frame assembly mountable in the base portion of the housing shown in FIG. 1.

FIG. 3 is a cross sectional view of the slotted formation in the base portion of the housing showing dimensional relationships; and FIG. 4 is a cross sectional view showing a sleeve mounted on a lug projecting from a machine side frame plugged into the base housing.

Figure 1:
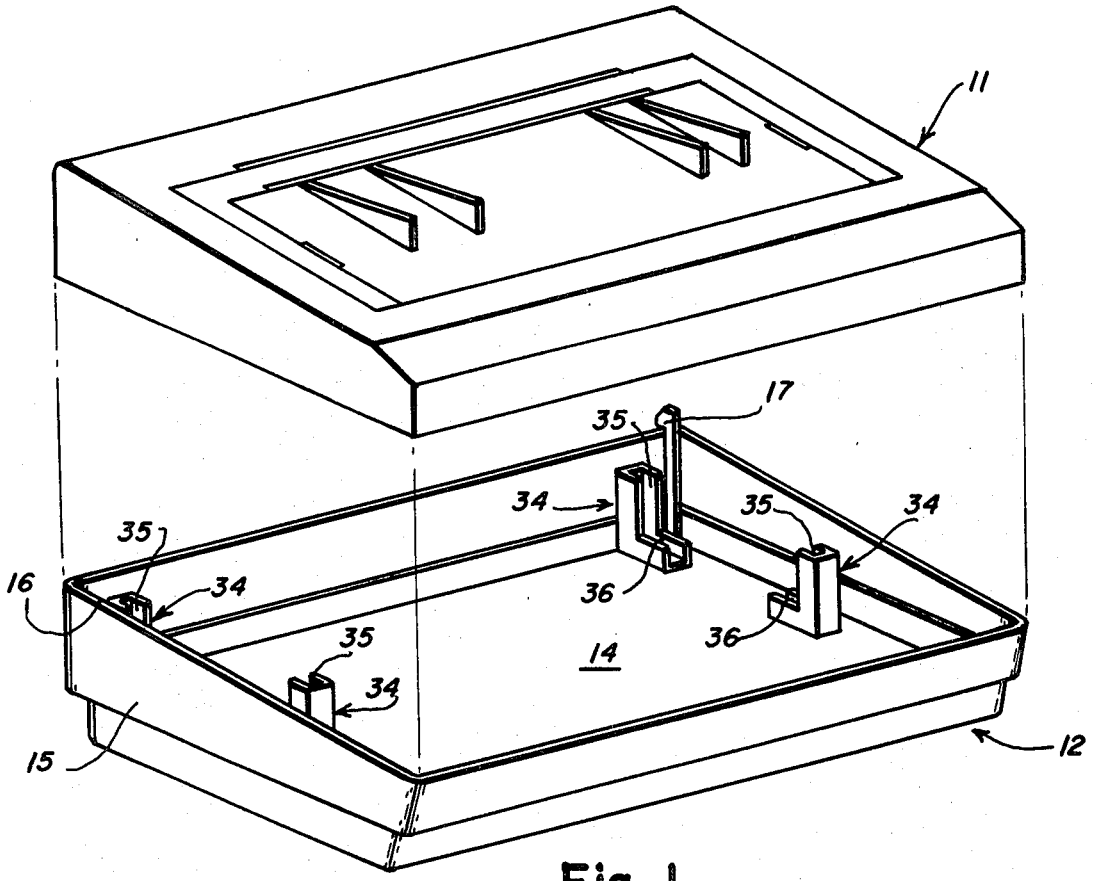
FIG. 1 is a exploded perspective view of a cover and base portion of a machine housing showing details of the base portion.

Referring now to the drawing wherein like reference numerals designate like or corresponding parts throughout the several views, there is shown in FIG. 1 a business machine housing, such as for example a printer, having a cover portion generally designated by reference numeral 11 which is provided with paper entry and exit slots, and a base portion generally designated by reference numeral 12 adapted to receive and provide the sole support for a machine frame generally designated by reference numeral 13 (FIG. 2).

The base portion 12 has a bottom wall 14 having about its perimeter an upwardly directed wall 15. The upper edge 16 of the wall 15 is adapted to support the cover portion 11 which is adopted to be mounted on and detentably removably secured to the base portion 12 following the mounting of the machine frame 13 in the base portion 12 as will hereinafter appear. To detentably removably secure the cover portion 11 to the base portion 12 there are provided at suitable locations flexible detents 17, only one of which is shown at a corner location, which extend upwardly from the bottom wall 14.

With reference to FIG. 2, the machine frame 13 comprises spaced side frames 18 and 19 formed of stamped metal having various holes and cutouts to support and accomodate various printer elements e.g. the shaft 21 of a platen 22 and a printer carriage guide rail 23.

Extending oppcsitely from the front and rear vertical edges 24 and 25 of the side frames 18 and 19 between the top and bottom edges 26 and 27 are projections or lugs 28, best seen in FIG. 4, on which are mounted caps or sleeves 29 of resilient material as, for example, rubber. Adjacent the lower corners of the side frames 18 and 19 notches 31 are cut to form lugs 32 inwardly of side lugs 28 on which caps or sleeves 33 of resilient material can be mounted on the lower corners of the side frames 18 and 19.

As viewed in FIG. 1 and FIG. 2 located on the base portion and extending upwardly from the bottom wall 14 are formations generally designated by reference numeral 34, which may be L-shaped, having a vertical slot 35 and a horizontal slot 36 adapted to accomodate vertical plug in entry of the lugs 28, 32 and mounted sleeves 29, 33 on the side walls 18 and 19. As viewed in FIG. 3 the width a of the slots 35, 36 is greater than the thickness b of the lugs 28, 32 but smaller than the width c of the sleeves 29, 33 of resilient material in relaxed or uncompressed state. Accordingly, when the machine frame 13 is pushed down into the vertical 35 and horizontal slots 36 of the formations 34, the sleeves 29 and 33 are deformed or compressed thereby to be resiliently clamped between the walls defining the slots 35, 36 and to thereby provide a secure connection which damps vibrations and insulates the housing from machine vibrations. As is evident all of the resiliently capped lugs 28, 32 serve to secure the machine frame 13 against side to side movement relative to the base housing 12 and in addition lugs 28, projecting from the front and back edges 24, 25 into the vertical slots 35, preclude front to back translational movement and, being located above the plane of the bottom wall 14 preclude as well pivoting movement relative to the base housing 12 about the point of connection to the lower corners of the side frames 18 and 19. This construction eliminates the necessity for connections between the machine frame 13 and the cover portion 11 of the housing.

Following the plug in assembly of the frame 13 to the base housing 12 the cover portion 11 is detentably secured to the base housing 12. The cover housing 11 may include a stop formation 37 as shown in FIG. 2 which bears on the upper edge 26 of one of the side frames 18 to preclude vertical movement of the frame 13 relative to the base portion 12 during transport of the housed machine from one location to another.

While the formations 34 are shown as taking a single L-shape, other formations providing vertical and horizontal slots 35, 36 for plug in reception of the side frames 18 and 19 are within the scope of the invention.

As is understood the cover portion 11 and base portion 12 of the housing may be expediently injection molded as single pieces including formations 34 and detents 17.

The invention claimed is:

1. In combination with housing means for a business machine comprising a base portion and a cover portion releasably supported by said base portion, and machine frame means supporting functional machine elements, comprising spaced side frames, means on said side frames and said base portion for supporting said machine frame solely in said base portion, comprising first resilient means mounted on the lower corners of said side frames, lugs extending from opposite side edges of said side frames between the lower and upper edge, second resilient means mounted on said lugs, and slotted formations on said base portion for receiving and compressing said first and second resilient means to thereby clampingly engage and secure said side frames against side to side, front to back and pivoting movement relative to said base portion.

2. The combination recited in claim 1, said side walls being notched adjacent their said lower corners forming lugs supporting said first resilient means.

3. The combination recited in claim 2, said slotted formations being L-shaped to receive said first and second resilient means mounted on said lugs.

* * * * *